US006415540B1

(12) United States Patent
Ringers

(10) Patent No.: US 6,415,540 B1
(45) **Date of Patent: *Jul. 9, 2002**

(54) FIREARM TRIGGER LOCK

(76) Inventor: Derek Ringers, 201 Middleton Ct., Churchville, MD (US) 21028

( * ) Notice: Subject to any disclaimer, the term of this patent is extended or adjusted under 35 U.S.C. 154(b) by 0 days.

This patent is subject to a terminal disclaimer.

(21) Appl. No.: 09/558,379

(22) Filed: Apr. 26, 2000

Related U.S. Application Data

(63) Continuation-in-part of application No. 09/411,334, filed on Oct. 1, 1999, now Pat. No. 6,272,784.

(51) Int. Cl.[7] ..... F41A 17/22; F41A 17/54
(52) U.S. Cl. ..... 42/70.07; 42/70.01
(58) Field of Search ..... 42/70.07, 70.11, 42/70.01, 70.06

(56) References Cited

U.S. PATENT DOCUMENTS

| | | | | | |
|---|---|---|---|---|---|
| 2,505,227 | A | * | 4/1950 | Charters | 42/70.07 |
| 2,742,726 | A | * | 4/1956 | Feller | 42/70.07 |
| 3,422,560 | A | * | 1/1969 | Foote et al. | 42/70.07 |
| 3,624,945 | A | * | 12/1971 | Foote | 42/70.11 |
| 3,732,641 | A | * | 5/1973 | Adajian | 42/70.07 |
| 4,050,662 | A | * | 9/1977 | Pickering | 42/70.07 |
| 4,299,045 | A | * | 11/1981 | Cervantes | 42/70.11 |
| 5,024,017 | A | * | 6/1991 | Nishioka | 42/70.07 |
| 5,050,328 | A | | 9/1991 | Insko | 42/70 |
| 5,392,551 | A | * | 2/1995 | Simpson | 42/70.07 |
| 5,400,538 | A | | 3/1995 | Shannon | 42/70.07 |
| 5,437,119 | A | * | 8/1995 | Womack | 42/70.07 |
| 5,450,684 | A | * | 9/1995 | Harris | 42/70.07 |
| 5,535,605 | A | | 7/1996 | Werner | 70/14 |
| 5,544,440 | A | | 8/1996 | Stockman | 42/70.07 |
| 5,551,181 | A | | 9/1996 | Upton | 42/70.11 |
| 5,638,627 | A | | 6/1997 | Klein | 42/70.07 |
| 5,647,158 | A | | 7/1997 | Eskelinen et al. | 41/70.07 |
| 5,680,723 | A | | 10/1997 | Rulz | 42/70.11 |
| 5,704,152 | A | | 1/1998 | Harrison et al. | 42/70.07 |
| 5,724,760 | A | | 3/1998 | Langner | 42/70.07 |
| 5,755,054 | A | | 5/1998 | Tuller | 42/70.07 |
| 5,768,819 | A | | 6/1998 | Neal | 42/96 |
| 5,778,586 | A | | 7/1998 | Carlson | 42/70.07 |
| 5,784,819 | A | | 7/1998 | Roper | 42/70.11 |
| 5,829,179 | A | | 11/1998 | Carter et al. | 42/70.07 |

* cited by examiner

*Primary Examiner*—Charles T. Jordan
*Assistant Examiner*—Kimberly S. Smith
(74) *Attorney, Agent, or Firm*—Larry J. Guffey

(57) ABSTRACT

A trigger lock (1) is disclosed for use on a firearm having a trigger and a trigger guard. In a preferred embodiment, this invention includes a plurality of spaced apart pins (2) and means for holding (3) and locking (4) these pins in their spaced apart relationship. These pins cooperate to prevent trigger movement when one of them is placed and held behind the trigger, while another is placed and held against the inside of the trigger guard at a position behind the trigger. Meanwhile, a preferred embodiment for holding these pins in this spaced apart relationship comprises: (a) a first and a second base, on which is mounted a pin that is positionable behind the trigger, (b) a latch plate slidably mounted between these bases, and on which a pin is mounted that is positionable against the trigger guard, (c) a keeper plate also mounted between these bases and movable between a locked and an unlocked position, wherein, when the keeper plate is in its locked position, it contacts and meshes with the latch plate so as to prevent the sliding motion of the latch plate, and (d) a means, attached to the keeper plate, for biasing the keeper plate to assume its unlocked position. Additionally, these bases are configured so as to provide a passage that allows for the locking means to exert a force upon the keeper plate so as to move it to its locked position.

13 Claims, 3 Drawing Sheets

FIREARM TRIGGER LOCK

CROSS-REFERENCE TO RELATED APPLICATION

This application is a continuation-in-part of application No. 09/411,334 now U.S. Pat. No. 6,272,784 B1 which issued on Aug. 14, 2001. The teachings of U.S. Pat. No. 6,272,784 B1 are incorporated herein by reference to the extent that they do not conflict with the teachings herein.

BACKGROUND OF THE INVENTION

1. Field of the Invention

The present invention generally relates to firearms. More particularly, this invention relates to an external trigger lock for firearms.

2. Description of the Related Art

The use of external, firearm trigger locks is well known in the prior art. More specifically, such locks are known basically to consist of familiar structural configurations. These devices utilize a plurality of different types of wrenches, keys and other locking systems to prevent unauthorized or accidental operation of the am. For example, U.S. Pat. No. 5,755,054 requires a special key wrench, whereas U.S. Pat. Nos. 5,400,538, 5,647,158, and 5,535,605 utilize various types of combination locks that do not require the separate use of a key or wrench. Meanwhile, U.S. Pat. No. 5,050,328 employs only a childproof locking system that disengages the lock by manually spreading a par of pins.

Many of these prior art devices are configured to totally enclose a firearm's trigger guard. For example, see U.S. Pat. Nos. 5,050,328, 5,400,538, 5,535,605, 5,544,440, 5,755,054, 5,778,586 5,704,152 and 5,829,179. Some even enclose portions of the firearm's barrel and handle. For example, see U. S. Pat. Nos. 5,768,819 and 5,680,723. Such enclosure techniques significantly differ from the present invention's total immobilization of a firearm's trigger, and leave the firearms that employ such techniques susceptible to the hazards associated with manipulating the enclosure in a manner so as to still allow the Am to be discharged.

The trigger lock according to the present invention substantially departs from conventional concepts and the design of the prior art, and in so doing provides an apparatus that is especially well suited for easy and rapid engagement and disengagement from a variety of firearms.

Despite the prior art, there exists a continuing need for new and improved firearm trigger locks. The present invention substantially fulfills many such needs.

SUMMARY OF THE INVENTION

In accordance with one preferred embodiment of the present invention, a new and improved trigger lock for use on a firearm having a trigger and a trigger guard comprises a pair of spaced apart pins that cooperate to prevent trigger movement by having one of the pins placed behind the trigger while the other pin is fixed against the inside of the trigger guard at a position behind the trigger, and means for holding and locking these pins in this spaced apart relationship.

In a preferred embodiment, the means for holding these pins in this spaced apart relationship comprises: (a) a first and a second base, with a pin that is positionable behind the trigger being mounted on this second base, (b) a latch plate slidably mounted between these bases, and on which a pin is mounted that is positionable against the trigger guard, (c) a keeper plate also mounted between these bases and movable between a locked and an unlocked position, wherein, when the keeper plate is in its locked position, it contacts and meshes with the latch plate so as to prevent the sliding motion of the latch plate, and (d) a means, attached to the keeper plate, for biasing the keeper plate to assume its unlocked position. Additionally, these bases are configured so as to provide a passage that allows for the locking means to exert a force upon the keeper plate so as to move it to its locked position.

Thus, there has thus been summarized above, rather broadly, the more important features of one embodiment of the present invention in order that the detailed description that follows may be better understood and appreciated. There are, of course, additional features of the invention that will be described hereinafter and which will form the subject matter of the claims appended thereto.

In this respect, before explaining at least one embodiment of the present invention in detail, it is to be understood that the invention is not limited m its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new trigger lock apparatus which has many of the advantages of the devices mentioned heretofore and many novel features that result in a firearm trigger lock which is not anticipated, rendered obvious, suggested, or even implied by any of the prior art devices, either alone or in any combination thereof.

It is another object of the present invention to provide a new and improved firearm trigger lock which may be easily and efficiently manufactured and marketed.

It is a further object of the present invention to provide a new and improved firearm trigger lock which is of durable and reliable construction.

It is a still further object of the present invention is to provide a new and improved firearm trigger lock which provides some of the advantages of the apparatuses of the prior art, while simultaneously overcoming some of the disadvantages normally associated therewith.

These and other objects and advantages of the present invention will become readily apparent as the invention is better understood by reference to the accompanying drawing and the detailed description that follows.

DESCRIPTION OF THE PREFERRED EMBODIMENT

Figure 1:
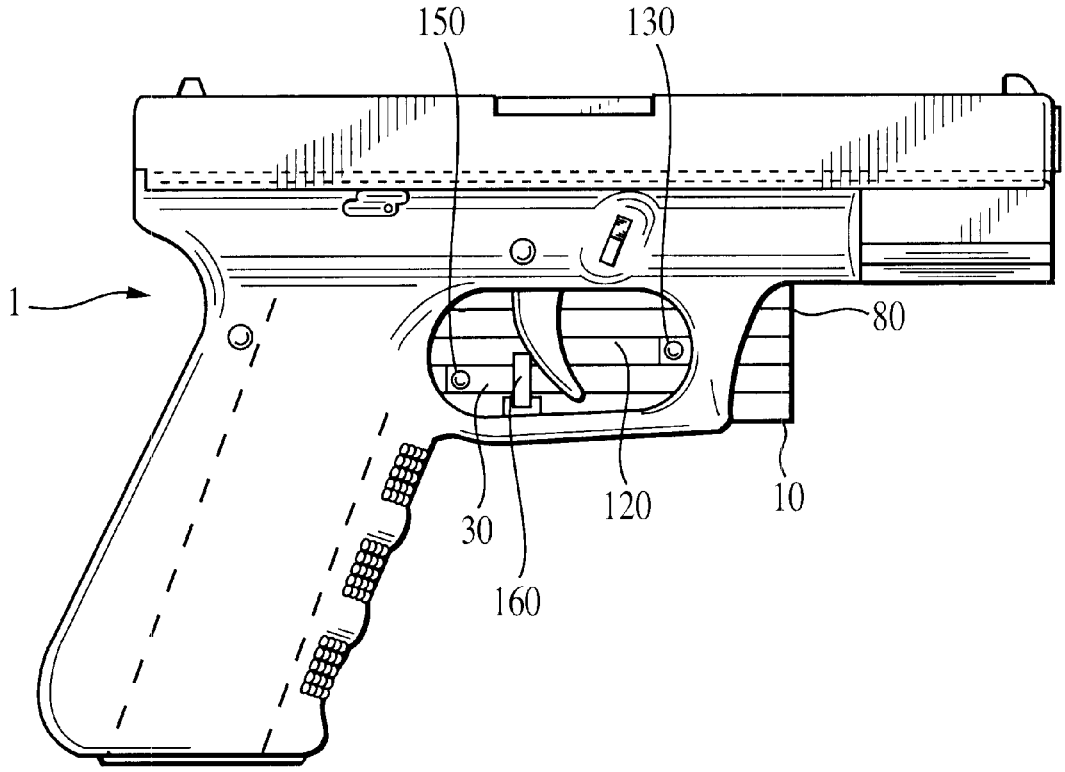
FIG. 1 is a side view of a preferred embodiment of the present invent which illustrates the placement of the invention on a firearm, having a trigger and a trigger guard, in such a manner as to prevent the firearm's operation.

Referring now to the drawings wherein are shown preferred embodiments and wherein like reference numerals designate like elements throughout, there is shown in FIG. 1 a side view of a preferred embodiment of the present invention which illustrates the placement of the invention on a farm, having a trigger and a trigger guard, in such a manner as to prevent the arm's operation.

Figure 2:
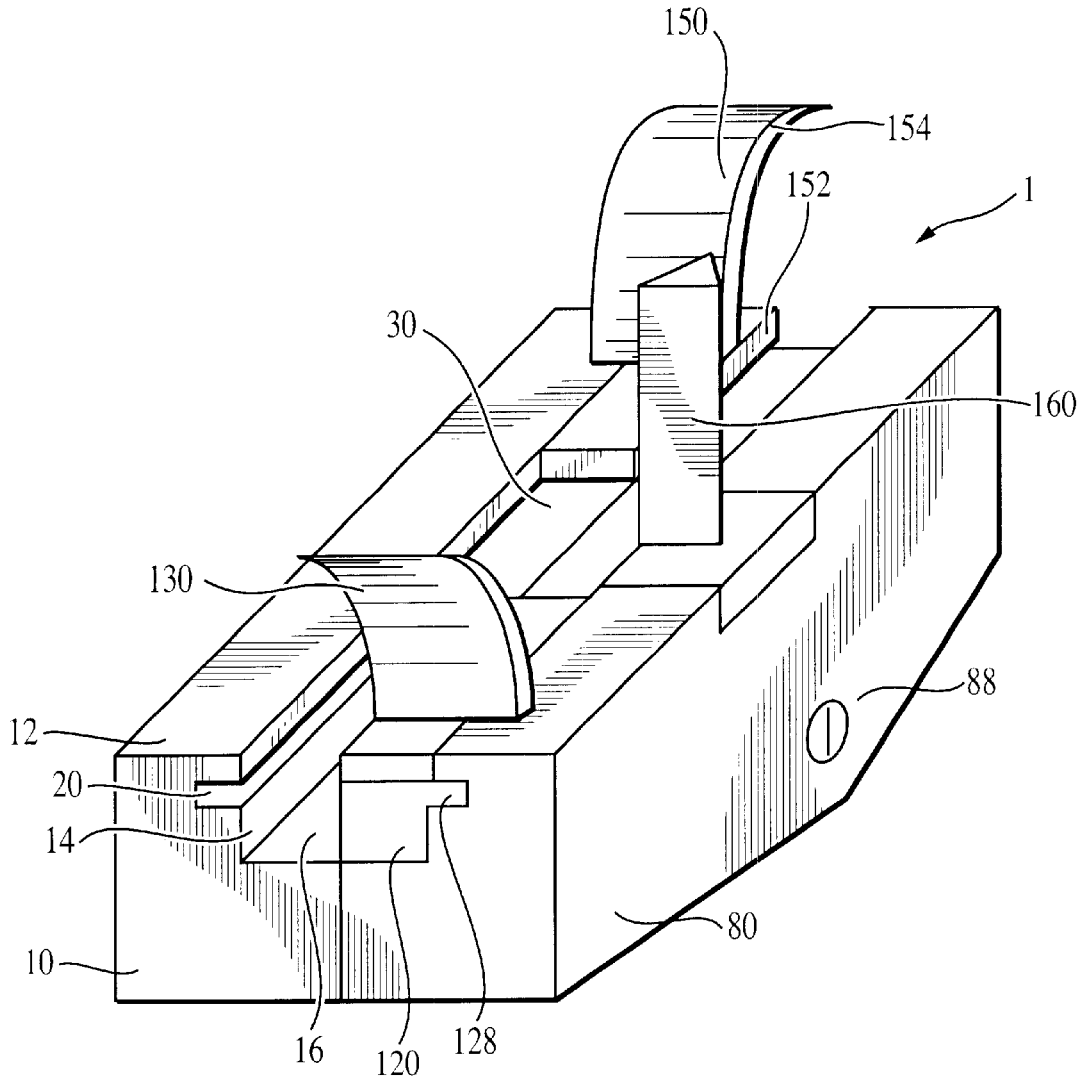
FIG. 2 is a perspective view of a preferred embodiment of the present invention.

FIG. 2 is a perspective view of a preferred embodiment of the present invention. It is seen to comprise three spaced apart pins (130, 150 and 160) that cooperate to prevent trigger movement by having one (160) of the pins placed behind the trigger, another (130) of the pins paced inside the front portion of the trigger guard, while the final pin (150) is fixed against the inside of the trigger guard at a position behind the trigger, and means for holding (3) and locking (4) these pins in this spaced apart relationship.

Figure 3:
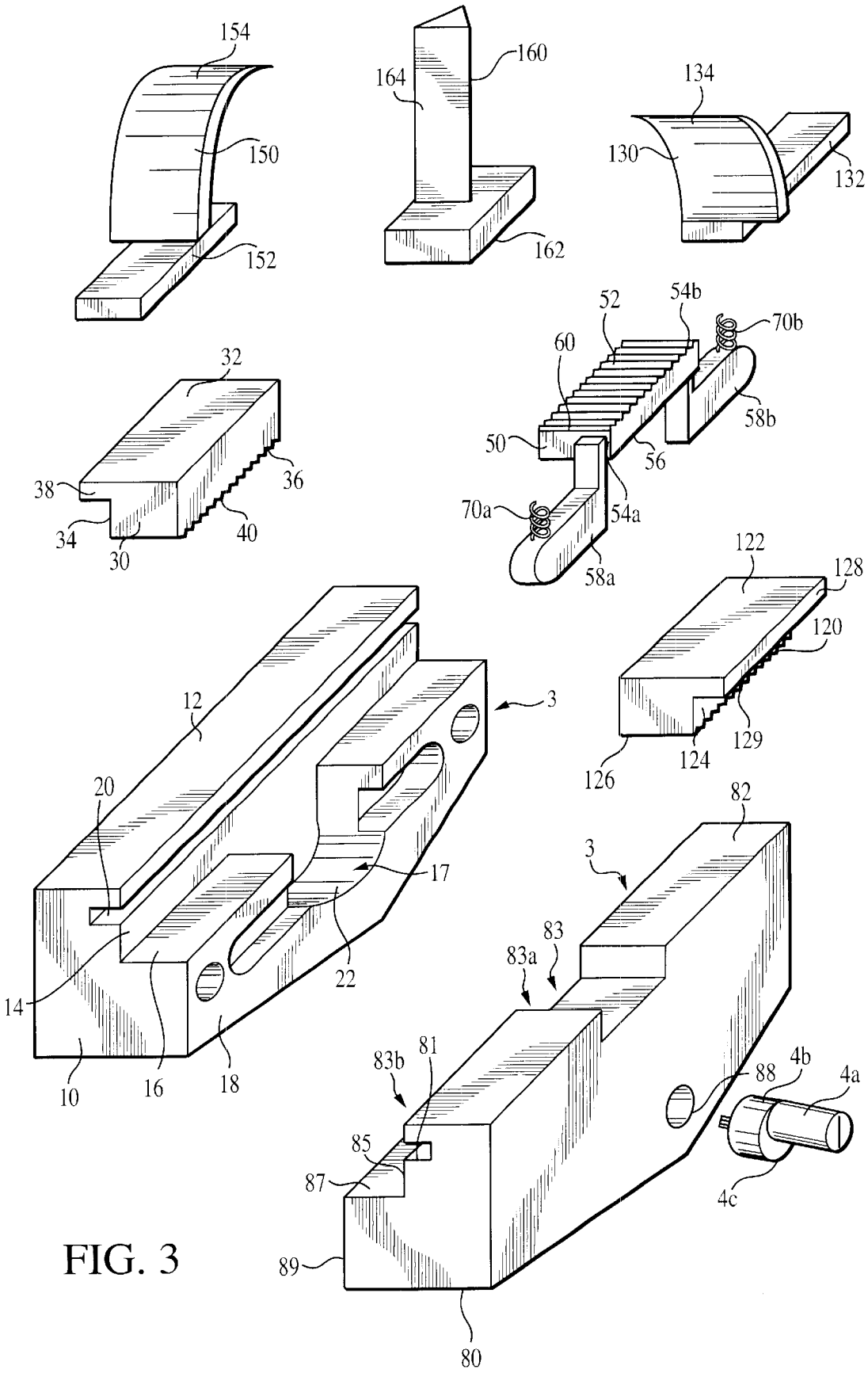
FIG. 3 is an exploded, perspective view of the elements that comprise the preferred embodiment shown in FIG. 2.

To better understand the internal elements of this preferred embodiment, FIG. 3 is provided and illustrates an exploded, perspective view of the elements that comprise the embodiment shown in FIG. 2.

The means for holding (3) the pins (130, 150, 160) in a spaced apart relationship is seen to comprise: (a) a first (10) and a second (80) base, with a pin (160) that is positionable behind the trigger being mounted on this second base, (b) a first (30) and a second (120) latch plate that are both slidably mounted between these bases, with a pin (150, 130) being, respectively, mounted on each of these plates (30, 120), (c) a keeper plate (50), also mounted between these bases, which is movable between a raised, locked and a lowered, unlocked position such that, when the keeper plate is in its locked position, it contacts and meshes with these latch plates (30, 120) so as to prevent their and the pins (150, 130) sliding motion, and (d) a means (70), attached to the keeper plate, for biasing the keeper plate to assume its unlocked position. Additionally, this second base (80) is configured so as to provide a passage (88) that allows for the locking means (4) to exert a force upon the keeper plate (50) so as to move it to its upper, locked position.

There obviously exist many ways of configuring these elements so that they Is can perform the necessary function of providing for the maneuverability of the trigger lock's pins. In the preferred embodiment shown in FIG. 3, these first and second bases are seen to, respectively, have top (12, 82), upper side (14, 85), ledge (16, 87) and lower side (18, 89) surfaces. Furthermore, each of these upper side (14, 85) surfaces has, respectively, an elongated groove (20, 81) which is used to guide the movement of the lock's latch plates (30, 120).

Each of these bases (10, 80) also has, respectively, a complimentary cavity (22, 83) which houses a portion of the keeper plate (50) and the locking means (4). These cavities are seen to be configured, respectively, so as to have similar top openings (24, 83*a*) through the respective ledge (16, 87) surfaces, and similar side openings (17, 83*b*) through their respective lower side (18, 89) surfaces. Additionally, the second base (80) further has the passage (88) which provides access from the lock's exterior surface to these cavities and the lock's keeper plate.

The latch plates (30, 120) each have, respectively, top (32, 122), side (34, 124) and bottom (36, 126) surfaces. Also, each of these plates' side surfaces (34, 124) has a finger (38, 128) configured to fit, respectively, within their respective base's elongated grooves (20, 81), so that the plate side surfaces (34, 124) slide along the bases' upper sides (14, 85). A portion of each of the plates' bottom surfaces (36, 126) has toothed sections (40, 129) which are used to mesh and lock these plates with the keeper plate.

The keeper plate (50) has top (52), two side (54*a*, 54*b*) and bottom (56) surfaces. From each of the side (54*a*, 54*b*) surfaces there extends an arm (58*a*, 58*b*). A portion of the top (52) surface is seen to have a toothed section (60) which is shaped so as to allow it to mesh with the toothed sections (40, 129) of the latch plates (30, 120) so as to restrict relative motion between the keeper (50) and latch (30, 120) plates when the keeper plate (50) is in its upper, locked position. The keeper plate (50) is configured so as to fit within the union of the cavities (22, 83) and to be movable between an elevated, locked and a lower, unlocked position. In this locked position, the keeper plate toothed section (60) is seen to extend through the cavity top openings (24, 83*a*) in order to mesh with the latch plate toothed sections (40, 129).

Biasing means (70), shown here in the form of springs (70*a*, 70*b*), are configured to fit between the top of the keeper plate arms (58*a*, 58*b*) and an adjoining, upper wall of the block's cavity (22, 83).

Each of the movable pins (150, 130) have, respectively, a plate (152, 132) end and a free (154, 134) end. The plate ends (152, 132) are affixed to the top surfaces (32, 122) of the latch plates with the free end (154, 134) extending approximately normal to these top surfaces (32, 122).

The locking means (4) shown in this embodiment is a key-actuated, cylinder-type lock (4*a*). The radius (4*c*) of the cylinder (4*b*) is seen to be vary and be a function of the radial angle around the axis of the cylinder or the face of the lock (4*a*). Thus, as a key rotates the lock's cylinder in such as way as to lock it, the larger radius section of the cylinder comes into contact with the bottom (56) of the keeper plate 50) and forces it upward so that it meshes with and locks the latch plates (30, 120) into their respective lateral positions.

For those familiar with lock technology, it is readily apparent that many other actuation means (e.g., electronic keypad) may be used with the cylinder lock used in this embodiment. Additionally, it should be recognized that there are many other commercially available locking mechanisms which can be used to cause the upward, locking motion of the keeper plate (50). The utilization of this alternative hardware is understood to be within the spirit and scope of the present invention.

Materials suitable for construction of the various elements of the present invention include aluminum and steel in order to maximize the lock's durability.

Although the foregoing disclosure relates to preferred embodiments of the invention, it is understood that these details have been given for the purposes of clarification only. Various changes and modifications of the invention will be apparent, to one having ordinary skill in the art, without departing from the spirit and scope of the invention as hereinafter set forth in the claims.

I claim:

1. A trigger lock (1) for use on a firearm having a trigger and a trigger guard, with the firing of said firearm being initiated by the rearward movement of said trigger, said lock comprising:

a plurality of pins (2) cooperating to prevent initiation of movement by said trigger, with one or more of said pins being movable between a first and a second spaced apart position, wherein in said second position said trigger movement is restricted by having one of said pins placed against a position on the rear portion of said trigger and another of said pins placed in a spaced apart relationship and against a position on the inside of said trigger guard and behind said trigger, a means (3) for moving and holding one or more of said pins in said spaced apart relationship so as to resist the rearward movement of said trigger, a means (4) for locking said pins (2) in said spaced apart relationship, wherein said means (3) for moving and holding one or more said pins in said spaced apart relationship comprising:

a first base (10) configured to have a top (12), an adjoining upper side (14), an adjoining ledge (16) and an adjoining lower side (18) surface, said upper side surface having an elongated groove (20), said first base (10) further having a cavity (22) configured so as to have a top opening (24) through said ledge (16) surface and a side opening (17) through said lower side (18) surface, a latch plate (30) having a top (32), a side (34) and a bottom (36) surface, said side surface (34) having a finger (38) configured to fit within said elongated groove (20) so that said plate side (34) is slidably mounted on said first base upper side (14), a portion of said plate bottom (36) surface having a toothed section (40), a keeper plate (50) having a top (52), a side (54) and a bottom (56) surface, said side (54) surface having an arm (58) extending from said side (54), a portion of said top (52) surface having a toothed section (60) configured to mesh with said plate toothed section (40) so as to restrict relative motion between said keeper (50) and latch (30) plates, said keeper plate (50) configured so as to fit within said cavity (22) and to be movable between a locked and an unlocked position, wherein, when in said locked position, said keeper plate toothed section (60) extends through said cavity top opening (24) in order to mesh with said latch plate toothed section (40), a means (70), configured to fit between said keeper plate arm (58) and an adjoining wall of said cavity (22), for biasing said keeper plate (50) for motion between said locked and unlocked positions, a second base (80) having a top (82), an adjoining side (84) surface and an opposite side (86) surface, said adjoining side surface (84) configured so as mate with said first base upper side (14), ledge (16) and lower side (18) surfaces to hold said latch plate finger (38) within said elongated groove (20) and to hold said keeper plate (50) within said cavity (22), said adjoining side (84) and opposite side (86) surfaces having extending there between a passage (88) that provides access through said side opening (17) to said cavity (22) and said keeper plate (50), and wherein said passage (88) configured to allow for said locking means (4) to exert a force upon said keeper plate (50) so as to move said plate to its locked position.

2. A trigger lock (1) as recited in claim 1, wherein at least one of said plurality of pins (2) comprising a movable pin (150), said pin being movable to said second position that is against a position on the inside of said trigger guard and behind said trigger, said pin (150) having a plate (152) end and a free (154) end, said plate end (152) being affixed to the top surface (32) of said latch plate such that said free end (154) extends approximately normal to said top surface (32), and wherein at least one of said plurality of pins (2) comprising a fixed pin (160) having a plate (162) end and a free (164) end, said plate end (162) being affixed to the top surface (82) of said second base (80) such that said free end (164) extends approximately normal to said surface (82) and is positionable against a position on the rear portion of said trigger.

3. A trigger lock (1) as recited in claim 1, wherein said second base adjoining side surface (84) further configured to have an adjoining upper side (85), an adjoining ledge (87) and an adjoining lower side (89) surface, said upper side surface having an elongated groove (81), said second base (80) further having a cavity (83) configured so as to have a top opening (83*a*) through said ledge (87) surface and a side opening (83*b*) through said lower side (89) surface, said second base passage (88) extending between said opposite side (86) and into said cavity (83), said lock further comprising a second latch plate (120) having a top (122), a side (124) and a bottom (126) surface, said side (124) having a finger (128) configured to fit within said elongated groove (81) so that said plate side (124) is slidably mounted on said second base upper side (85), a portion of said plate bottom (126) surface having a toothed section (129), wherein said a keeper plate toothed section (60) further configured to mesh with said second latch plate toothed section (129) so as to restrict relative motion between said keeper plate (50) and said second latch plate (120), said keeper plate (50) further configured so as to fit within the union of said cavities (22, 83) and to be movable between a locked and an unlocked position, wherein, when in said locked position, said keeper plate toothed section (60) extends through said second base cavity top opening (83*a*) in order to mesh with said second latch plate toothed section (129), and wherein at least one of said plurality of pins (2) comprising a second movable pin (130), said pin being movable to said second position that is against a position on the inside of said trigger guard and in front of said trigger, said pin (130) having a plate (132) end and a free (134) end, said plate end (132) being affixed to the top surface (122) of said second latch plate such that said free end 134) extends approximately normal to said top surface (122).

4. A trigger lock (1) for use on a firearm having a trigger and a trigger guard, with the firing of said firearm being initiated by the rearward movement of said trigger, said lock comprising:

a first (150) and a second pin (160) that cooperate to prevent initiation of movement by said trigger, with said first pin (150) being movable between a first and a second spaced apart position, wherein in said second position said trigger movement is restricted by having said second pin (160) placed against a position on the rear portion of said trigger and said first pin (150) placed in a spaced apart relationship and against a position on the inside of said trigger guard and behind said trigger, a means (3) for moving and holding one or more of said pins in said spaced apart relationship so as to resist the rearward movement of said trigger, a means (4) for locking said pins (150,160) in said spaced apart relationship.

5. A trigger lock (1) as recited in claim 4, wherein said means (3) for moving and holding one or more said pins in said spaced apart relationship comprising:

a first base (10), a second base (80), a latch plate (30) slidably mounted between said bases (10, 80), a keeper plate (50) mounted between said bases (10, 80) and movable between a locked and an unlocked position, wherein, when in said locked position, said keeper plate (50) contacts and meshes with said latch plate (40) so as to prevent the sliding motion of said latch plate (40), a means (70), attached to said keeper plate (50), for biasing said keeper plate (50) to assume its unlocked position, wherein said bases (10, 80) configured so as to provide a passage (88) that allows for said locking means (4) to exert a force upon said keeper plate (50) so as to move said keeper plate (50) to its locked position, and wherein said first pin (150) being mounted on said latch plate (30) and said second pin (160) being fixedly mounted on said second base (80).

6. A trigger lock (1) as recited in claim 5, wherein said first base (10) having a top (12), an adjoining upper side (14), an adjoining ledge (16) and an adjoining lower side (18) surface, said upper side surface having an elongated groove (20), said first base (10) further having a cavity (22) configured so as to have a top opening (24) through said ledge (16) surface and a side opening (17) through said lower side (18) surface.

7. A trigger lock (1) as recited in claim 6, wherein said latch plate (30) having a top (32), a side (34) and a bottom (36) surface, said side surface (34) having a finger (38) configured to fit within said elongated groove (20) so that said plate side (34) is slidably mounted on said first base upper side (14), a portion of said plate bottom (36) surface having a toothed section (40).

8. A trigger lock (1) as recited in claim 7, wherein said keeper plate (50) having a top (52), a side (54) and a bottom (56) surface, said side (54) surface having an arm (58) extending from said side (54), a portion of said top (52) surface having a toothed section (60) configured to mesh with said plate toothed section (40) so as to restrict relative motion between said keeper (50) and latch (30) plates, said keeper plate (50) configured so as to fit within said cavity (22) and to be movable between a locked and an unlocked position, wherein, when in said locked position, said keeper plate toothed section (60) extends through said cavity top opening (24) in order to mesh with said latch plate toothed section (40).

9. A trigger lock (1) as recited in claims wherein said biasing means (70) configured to fit between said keeper plate arm (58) and an adjoining wall of said cavity (22).

10. A trigger lock (1) as recited in claim 9, wherein said second base (80) having a top (82), an adjoining side (84) surface and an opposite side (86) surface, said adjoining side surface (84) configured so as mate with said first base upper side (14), ledge (16) and lower side (18) surfaces to hold said latch plate finger (38) within said elongated groove (20) and to hold said keeper plate (50) within said cavity (22).

11. A trigger lock (1) as recited in claim 10, wherein said first pin (150) having a plate (152) end and a free (154) end, said plate end (152) being affixed to the top surface (32) of said latch plate such that said free end (154) extends approximately normal to said top surface (32).

12. A trigger lock (1) as recited in claim 11, wherein said second pin (160) having a plate (162) end and a free (164) end, said plate end (162) being affixed to the top surface (82) of said second base (80) such that said free end (164) extends approximately normal to said surface (82).

13. A trigger lock (1) as recited in claim 12, wherein said second base adjoining side surface (84) further having an adjoining upper side (85), an adjoining ledge (87) and an adjoining lower side (89) surface, said upper side surface having an elongated groove (81), said second base (80) further having a cavity (83) configured so as to have a top opening (83*a*) through said ledge (87) surface and a side opening (83*b*) through said lower side (89) surface, said passage (88) extending between said opposite side (86) and into said cavity (83), said lock further comprising a second latch plate (120) having a top (122), a side (124) and a bottom (126) surface, said side (124) having a finger (128) configured to fit within said elongated groove (81) so that said plate side (124) is slidably mounted on said second base upper side (85), a portion of said plate bottom (126) surface having a toothed section (129), wherein said a keeper plate toothed section (60) further configured to mesh with said second latch plate toothed section (129) so as to restrict relative motion between said keeper plate (50) and said second latch plate (120), said keeper plate (50) further configured so as to fit within the union of said cavities (22, 83) and to be movable between a locked and an unlocked position, wherein, when in said locked position, said keeper plate toothed section (60) extends through said second base cavity top opening (83*a*) in order to mesh with said second latch plate toothed section (129), and said lock further comprising a second movable pin (130), said pin being movable to said second position that is against a position on the inside of said trigger guard and in front of said trigger, said pin (130) having a plate (132) end and a free (134) end, said plate end (132) being affixed to the top surface (122) of said second latch plate such that said free end 134) extends approximately normal to said top surface (122).

* * * * *